US011626056B2

(12) United States Patent
Fujino et al.

(10) Patent No.: US 11,626,056 B2
(45) Date of Patent: Apr. 11, 2023

(54) IMAGE PROCESSING DEVICE AND IMAGE PROCESSING METHOD

(71) Applicant: Seiko Epson Corporation, Tokyo (JP)

(72) Inventors: Makoto Fujino, Shiojiri (JP); Takuya Ono, Shiojiri (JP); Katsuyuki Tanaka, Matsumoto (JP); Takumi Shimomukai, Matsumoto (JP)

(73) Assignee: SEIKO EPSON CORPORATION

( * ) Notice: Subject to any disclaimer, the term of this patent is extended or adjusted under 35 U.S.C. 154(b) by 0 days.

(21) Appl. No.: 17/534,628

(22) Filed: Nov. 24, 2021

(65) Prior Publication Data

US 2022/0172662 A1 Jun. 2, 2022

(30) Foreign Application Priority Data

Nov. 27, 2020 (JP) ..... JP2020-197288

(51) Int. Cl.
*G09G 3/20* (2006.01)

(52) U.S. Cl.
CPC ..... *G09G 3/2003* (2013.01); *G09G 2340/06* (2013.01)

(58) Field of Classification Search
None
See application file for complete search history.

(56) References Cited

U.S. PATENT DOCUMENTS

2003/0128376 A1 7/2003 Simpson et al.
2011/0310411 A1 12/2011 Hirano
2012/0200589 A1* 8/2012 Min ..... H04N 1/6027 345/591
2017/0061848 A1* 3/2017 Nakagoshi ..... G06T 7/90

FOREIGN PATENT DOCUMENTS

JP 2004-005385 A 1/2004
JP 2012-004931 A 1/2012

* cited by examiner

*Primary Examiner* — Yingchun He
(74) *Attorney, Agent, or Firm* — Harness, Dickey & Pierce, P.L.C.

(57) ABSTRACT

An image processing device includes an image input section configured to receive input of an image, a chromatic value acquisition section configured to obtain a chromatic value with respect to each of pixels of the image, an RGB conversion section configured to convert the chromatic value of each of the pixels of the image into an unnormalized linear RGB value expressed by a linear RGB value based on a characteristic of a display which outputs the image, a normalization section configured to divide the unnormalized linear RGB value by a modulus higher than a maximum value of linear RGB values which express displayable colors of the display to thereby generate a normalized linear RGB value when the unnormalized linear RGB value of at least one of the pixels is higher than the maximum value, an outputting RGB conversion section configured to convert the normalized linear RGB value into a display outputting RGB value, and an output section configured to output the display outputting RGB value to the display.

12 Claims, 10 Drawing Sheets

IMAGE PROCESSING DEVICE AND IMAGE PROCESSING METHOD

The present application is based on, and claims priority from JP Application Serial Number 2020-197288, filed Nov. 27, 2020, the disclosure of which is hereby incorporated by reference herein in its entirety.

BACKGROUND

1. Technical Field

The present disclosure relates to an image processing device and an image processing method.

2. Related Art

In JP-A-2012-4931 (Document 1), there is disclosed the fact that in order to check in advance an image to be formed on a form by a printing device such a printer or a copy machine, the image is displayed on a display device such as a display (previewed), and then, when the image includes a color out of the band of the display, the display is performed with data of that color compressed.

In the method of Document 1, since the compression is performed toward the white side (a high-luminance side), when an extra-color gamut color high in luminance represented by a fluorescent color which cannot be displayed by the display is included in the image to be printed by the printing device, it is unachievable to intuitively figure out a relative relationship with other colors on the display. Therefore, it has been desired to display the image after being normalized within the band of the display without breaking the relative relationship with the other colors on the display even when the extra-color gamut color high in luminance represented by the fluorescent color is included in the colors of the image.

SUMMARY

According to an aspect of the present disclosure, there is provided an image processing device. The image processing device includes an image input section configured to receive input of an image, a chromatic value acquisition section configured to obtain a chromatic value with respect to each of pixels of the image, an RGB conversion section configured to convert the chromatic value of each of the pixels of the image into an unnormalized linear RGB value expressed by a linear RGB value based on a characteristic of a display which outputs the image, a normalization section configured to divide the unnormalized linear RGB value by a modulus higher than a maximum value of linear RGB values which express displayable colors of the display to thereby generate a normalized linear RGB value when the unnormalized linear RGB value of at least one of the pixels is higher than the maximum value, an outputting RGB conversion section configured to convert the normalized linear RGB value into a display outputting RGB value, and an output section configured to output the display outputting RGB value to the display.

According to an aspect of the present disclosure, there is provided an image processing method. The image processing method includes the steps of receiving input of an image, obtaining a chromatic value with respect to each of pixels of the image, converting the chromatic value of each of the pixels of the image into an unnormalized linear RGB value expressed by a linear RGB value based on a characteristic of a display which outputs the image, dividing the unnormalized linear RGB value by a modulus higher than a maximum value of linear RGB values which express displayable colors of the display to thereby generate a normalized linear RGB value when the unnormalized linear RGB value of at least one of the pixels is higher than the maximum value, converting the normalized linear RGB value into a display outputting RGB value, and outputting the display outputting RGB value to the display.

DESCRIPTION OF EXEMPLARY EMBODIMENTS

First Embodiment

Figure 1:
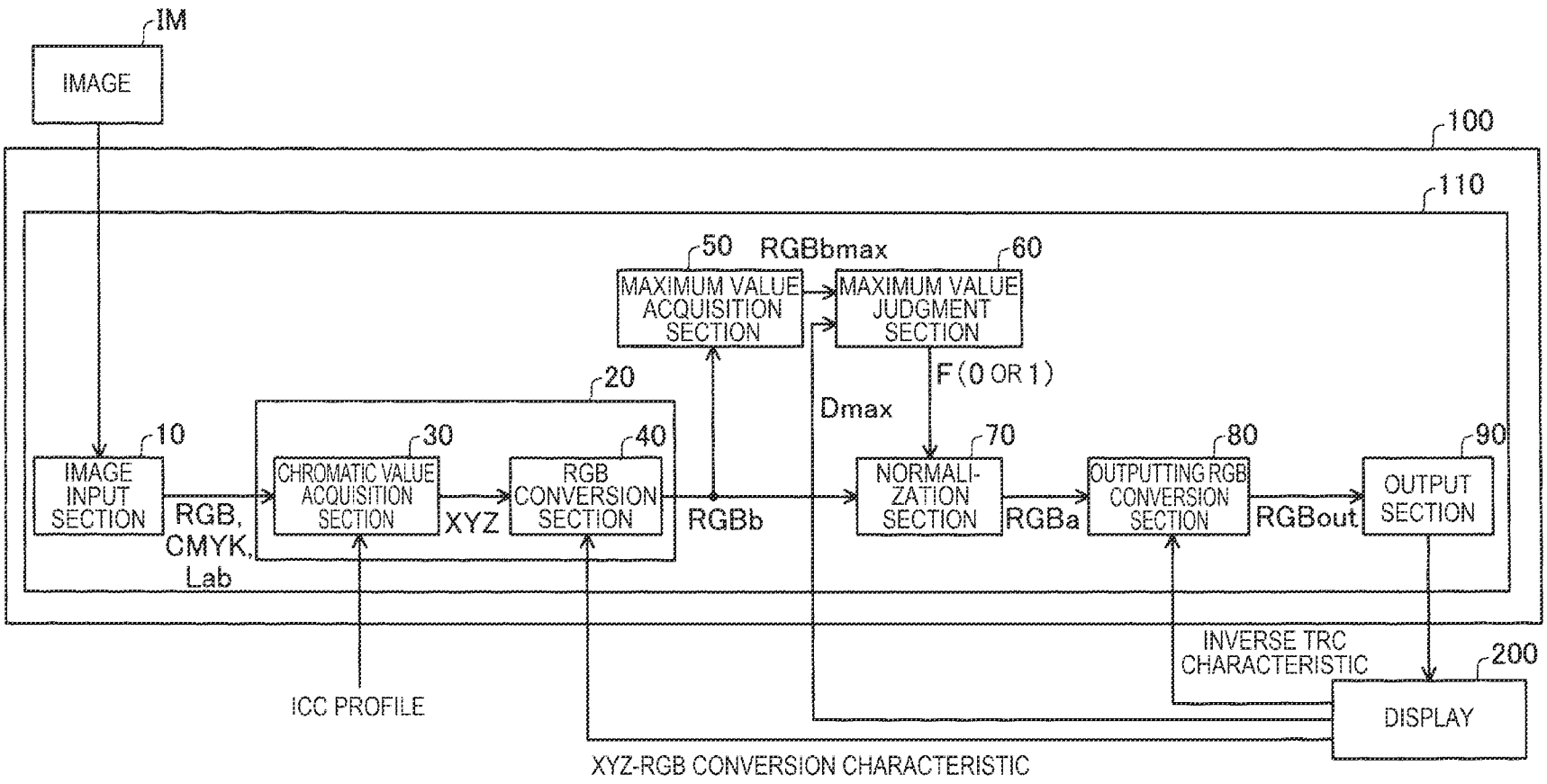
FIG. 1 is an explanatory diagram showing a configuration of an image processing device according to a first embodiment.

FIG. 1 is an explanatory diagram showing a configuration of an image processing device 100 according to a first embodiment. When a display 200 displays an image IM and when a pixel having a color which cannot be displayed by the display 200 and is high in luminance such as a fluorescent color is included in the image IM, the display 200 decreases the luminance of the pixel having the color high in luminance to the luminance which can be expressed on the display to display the pixel. On this occasion, when the display 200 supposedly displays the pixel having a color which can be displayed by the display 200 and is not high in luminance without changing the luminance, the color balance between the pixels in the image IM to be displayed by the display 200 is lost. The image processing device 100 is disposed in the anterior stage of the display 200, and performs conversion processing on the colors of the image IM so as not to lose the color balance between the pixels in the image IM to be displayed by the display 200.

The image processing device 100 is provided with an image input section 10, a display-displaying unnormalized linear RGB value generation section 20, a maximum value acquisition section 50, a maximum value judgment section 60, a normalization section 70, an outputting RGB conversion section 80, an output section 90, and a CPU 110.

The image input section 10 receives input of the image IM, and reads a signal value corresponding to an input device for each of the pixels of the image IM. The signal value includes, for example, an RGB value, a CMYK value, and an Lab value. The image input section 10 can be a different device such as a scanner, a device which receives input of the image IM from an image formation device to read out the signal value thereof, or a computer program for making the image input section 10 itself select a color such as an RGB value, a CMYK value, or an Lab value to form the image IM.

The display-displaying unnormalized linear RGB value generation section 20 converts an input signal of the image IM into an unnormalized linear RGB value RGBb. The term "unnormalized" means "the normalization process by the normalization section 70 described later has not been performed," and the term "normalized" means "the normalization process by the normalization section 70 has already been performed." The normalization will be described later.

The display-displaying unnormalized linear RGB value generation section 20 is provided with a chromatic value acquisition section 30 and an RGB conversion section 40. The chromatic value acquisition section 30 receives the input signal of the image IM as the chromatic values (Lab values), and then further converts the chromatic values (Lab values) into tristimulus values (XYZ values). Here, when the image input signal represents the CMYK values or the RGB values, conversion into the Lab values is performed along a conversion rule described in an ICC profile which is embedded in the image or designated by the user.

The chromatic values (Lab values) and the tristimulus values (XYZ values) are in the following relationship, and can therefore be converted to each other.

(1) Conversion From Lab Into XYZ

The tristimulus values (XYZ values) at CIE XYZ as a white point used as a reference are defined as Xn, Yn, and Zn, and $f_y=(L'+16)/116$, $f_x=f_y+a^*/500$, $f_z=f_y-b^*/200$, and $\delta=6/29$ are defined.

$$\text{If } f_y>\delta,\ Y=Y_n(f_y)^3,\ \text{else } Y=3(f_y-16/116)\delta^2 Y_n$$

$$\text{If } f_x>\delta,\ X=X_n(f_x)^3,\ \text{else } X=3(f_x-16/116)\delta^2 X_n$$

$$\text{If } f_z>\delta,\ Z=Z_n(f_z)^3,\ \text{else } Z=3(f_z-16/116)\delta^2 Z_n$$

(2) Conversion From XYZ Into Lab $$L^* = f(Y/Y_n) - 16$$

-continued $$a^* = 500\{f(X/X_n) - f(Y/Y_n)\}$$

$$b^* = 200\{f(Y/Y_n) - f(Z/Z_n)\}$$

here, assuming $\delta=6/29$, and if $t>\delta^3$, $f(t)=t^{(1/3)}$, else $f(t)=(1/3)\ (29/6)^2 t+4/29$ The RGB conversion section 40 converts the tristimulus values (XYZ values) into the unnormalized linear RGB values RGBb using an XYZ-linear RGB conversion characteristic of the display 200. Here, the XYZ-linear RGB conversion characteristic is described in a display profile provided from the manufacturer of the display 200. The display profile can be obtained from, for example, a website of the manufacturer. Alternatively, it is possible to prepare the display profile using what is prepared by the user with a profile preparation tool. Here, a maximum value of the linear RGB value which is normalized and can be displayed by the display 200 is 1.

Here, the display profile is described along the specification of the ICC profile, and the RGB conversion section 40 converts the tristimulus values (XYZ values) into the unnormalized linear RGB values RGBb using, for example, the following 3×3 matrix.

[Math. 1]

$$\begin{pmatrix} R(i,j) \\ G(i,j) \\ B(i,j) \end{pmatrix} = \begin{pmatrix} m11 & m12 & m13 \\ m21 & m22 & m23 \\ m31 & m32 & m33 \end{pmatrix} \begin{pmatrix} X(i,j) \\ Y(i,j) \\ Z(i,j) \end{pmatrix} \quad (1)$$

In the above formula, assuming the size of the image IM as X×Y pixels (X, Y are each a natural number), i represents an x coordinate in the image IM, and is in a range of 1 through X. Further, j represents a y coordinate in the image, and is in a range of 1 through Y. The values of m11 through m33 are different depending on chromatic characteristics of the primary colors of RGB of the display to be used.

The unnormalized linear RGB value RGBb(i,j) is a value obtained by the RGB conversion section 40 calculating the chromatic value of the image IM input thereto using the XYZ-linear RGB conversion characteristic described in the display profile. Therefore, the unnormalized linear RGB value RGBb(i,j) exceeds a maximum value Dmax (=1) of the RGB value which can be displayed by the display 200 in some cases depending on the chromatic value of the image IM. In this case, since the color which is high in luminance and cannot be displayed by the display 200 is included in the image IM as a result, the image processing device 100 performs the normalization process described later, and then displays the result on the display 200.

The maximum value acquisition section 50 obtains an unnormalized maximum value RGBbmax as a maximum value of the unnormalized linear RGB value RGBb of all of the pixels using the following formula.

$$RGBb\max = \max(R(i,j), G(i,j), B(i,j))$$

The maximum value judgment section 60 sets the unnormalized maximum value RGBbmax of the unnormalized linear RGB value RGBb as a judgment value αmax. The maximum value judgment section 60 judges whether or not the judgment value αmax has exceeded 1, and then sets a flag F (sets F=1) when the judgment value αmax has exceeded 1, or resets the flag F (sets F=0) when the judgment value αmax is no higher than 1.

When the flag F is equal to 1, the normalization section 70 divides the unnormalized linear RGB value RGBb by a modulus k to thereby perform the normalization to generate a normalized linear RGB value RGBa. The modulus k is a value greater than 1, and can also be the judgment value αmax for the unnormalized linear RGB value RGBb. When the flag F is equal to 0, the unnormalized linear RGB value RGBb is set as the normalized linear RGB value RGBa.

The outputting RGB conversion section 80 converts the normalized linear RGB value RGBa into a display outputting RGB value RGBout using an inverse TRC characteristic of the display 200. Since a TRC characteristic of the display 200 is provided from the manufacturer of the display 200, it is possible for the outputting RGB conversion section 80 to calculate the inverse TRC characteristic from the TRC characteristic.

The display outputting RGB value RGBout output by the outputting RGB conversion section 80 is output to the display 200 by the output section 90.

The CPU 110 controls the operations of the image input section 10, the RIP 20 (the chromatic value acquisition section 30 and the RGB conversion section 40), the maximum value acquisition section 50, the maximum value judgment section 60, the normalization section 70, the outputting RGB conversion section 80, and the output section 90. It should be noted that it is possible to configure the image input section 10, the display-displaying unnormalized linear RGB value generation section 20 (the chromatic value acquisition section 30 and the RGB conversion section 40), the maximum value acquisition section 50, the maximum value judgment section 60, the normalization section 70, the outputting RGB conversion section 80, and the output section 90 as a computer program to be executed by the CPU 110.

Figure 2:
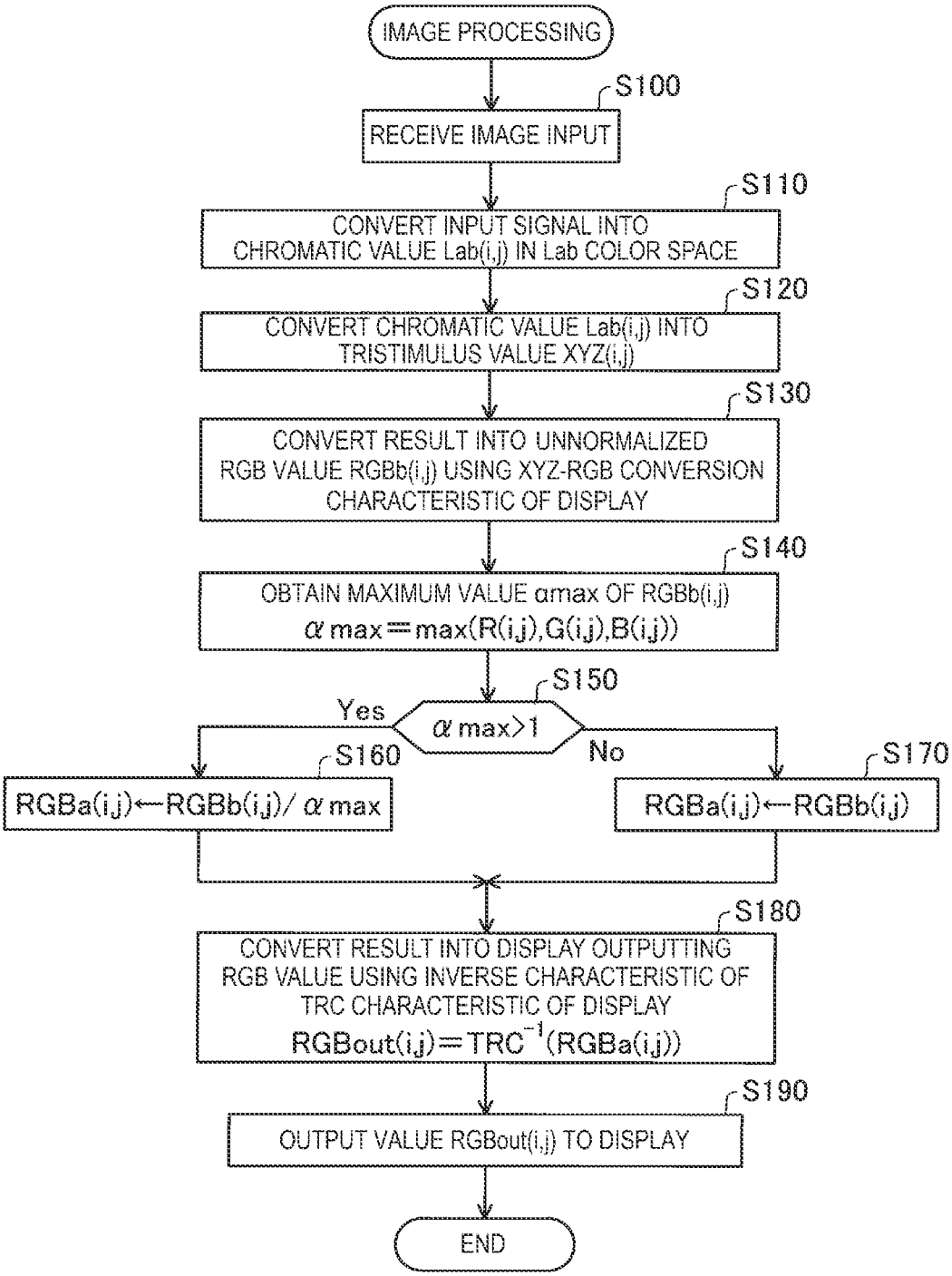
FIG. 2 is an image processing flowchart executed by a CPU.

FIG. 2 is an image processing flowchart executed by the CPU 110. In the step S100, when the input of the image IM to the image processing device 100 occurs, the CPU 110 receives the input of the image IM using the image input section 10, and reads out the signal value corresponding to input image data for each of the pixels of the image IM. As described above, as the signal value, there are cited the RGB value, the CMYK value, and the Lab value.

In the step S110, the CPU 110 converts the input signal of the image IM into the chromatic value Lab(i,j) for each of the pixels of the image IM using the chromatic value acquisition section 30. In the step S120, the CPU 110 converts the chromatic value Lab(i,j) into the tristimulus value XYZ(i,j) for each of the pixels of the image IM using the chromatic value acquisition section 30. It should be noted that in this conversion, when the input signal of the image IM is the RGB value or the CMYK value except the Lab value, the ICC (International Color Consortium) profile embedded in the image IM or designated is used.

In the step S130, the CPU 110 converts the tristimulus value XYZ(i,j) of the image IM into the unnormalized linear RGB value RGBb(i,j) as the device color RGB in the RGB space using the RGB conversion section 40 and the XYZ-RGB conversion characteristic obtained from the manufacturer of the display 200.

In the step S140, the CPU 110 obtains the unnormalized maximum value RGBbmax of the unnormalized linear RGB value RGBb of all of the pixels with the following formula using the maximum value acquisition section 50.

$$RGBb\max = \max(R(i, j), G(i, j), B(i, j))$$

In the above formula, i is in a range of 1 through X, and j is in a range of 1 through Y.

Here, when the input signal of the image IM includes a color high in luminance such as a fluorescent color, the unnormalized maximum value RGBbmax exceeds the maximum value Dmax of the RGB value which can be displayed by the display 200 in some cases when performing the conversion into the device color in the RGB space of the display 200 to be used. It should be noted that, as long as the RGB value which can be displayed by the display 200 is normalized, the maximum value Dmax is 1.

In the step S150, the CPU 110 sets the unnormalized maximum value RGBbmax as the judgment value αmax to judge whether or not the judgment value αmax exceeds 1 using the maximum value judgment section 60. When the judgment value αmax exceeds 1, the CPU 110 sets the flag F to 1, and makes the transition of the processing to the step S160, and when the judgment value αmax is no higher than 1, the CPU 110 sets the flag F to 0, and makes the transition of the processing to the step S170.

In the step S160, the CPU 110 divides the unnormalized linear RGB value RGBb(i,j) by the judgment value αmax to thereby convert the unnormalized linear RGB value RGBb (i,j) into the normalized linear RGB value RGBa(i,j) for each of the pixels as shown in the following formula using the normalization section 70.

$$RGBa(i, j) = RGBb(i, j)/\alpha\max$$

In the above formula, i is in a range of 1 through X, and j is in a range of 1 through Y.

Figure 3:
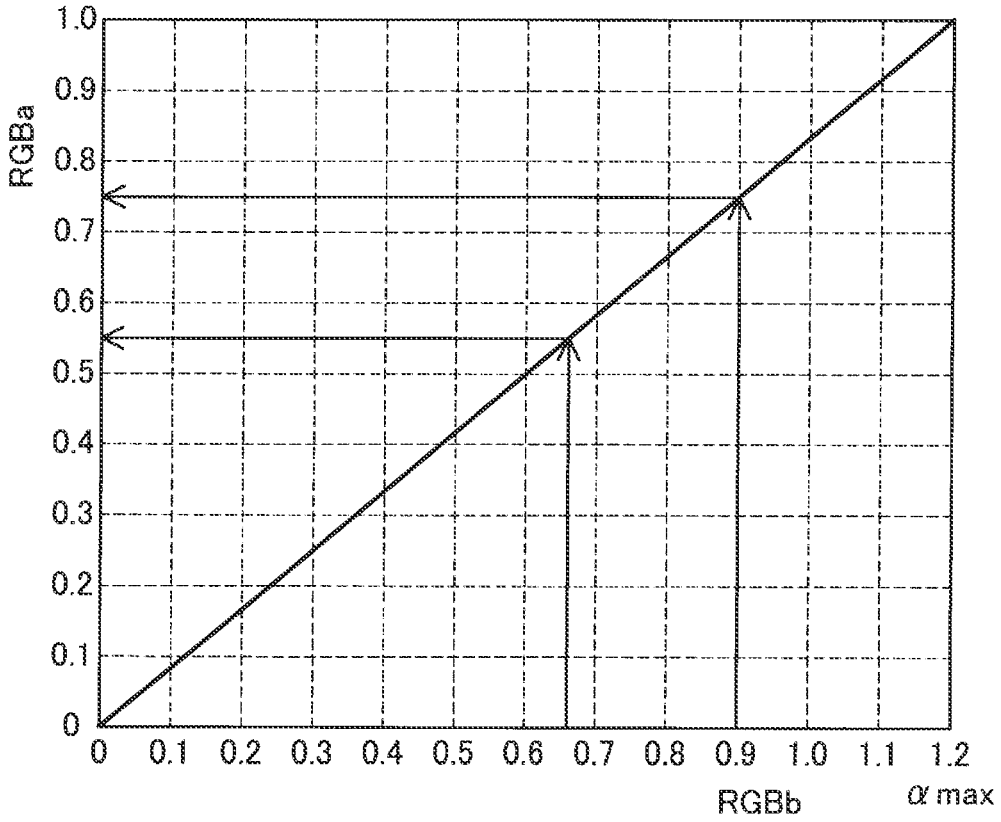
FIG. 3 is a graph showing a relationship between an unnormalized linear RGB value and a normalized linear RGB value.

FIG. 3 is a graph showing a relationship between the unnormalized linear RGB value RGBb and the normalized linear RGB value RGBa. In FIG. 3, the judgment value αmax is assumed as 1.2. For example, in the pixel having the unnormalized linear RGB value RGBb of 0.9, the normalized linear RGB value RGBa of 0.75 (=0.9/1.2) is obtained by the conversion, and in the pixel having the unnormalized linear RGB value RGBb of 0.66, the normalized linear RGB value RGBa of 0.55 (=0.66/1.2) is obtained by the conversion.

In the step S170 shown in FIG. 2, the CPU 110 converts the unnormalized linear RGB value RGBb(i,j) into the normalized linear RGB value RGBa(i,j) for each of the pixels with the following formula using the normalization section 70.

$$RGBa(i, j) = RGBb(i, j)$$

In the above formula, i is in a range of 1 through X, and j is in a range of 1 through Y.

In other words, when the judgment value αmax is no higher than 1, the normalized linear RGB value RGBa(i,j) takes the same value as the unnormalized linear RGB value RGBb(i,j).

In the step S180, the CPU 110 converts the normalized linear RGB value RGBa(i,j) into the display outputting RGB value RGBout(i,j) with the following formula using the outputting RGB conversion section 80 and the inverse characteristic of the TRC characteristic described in the display profile.

$$RGBout(i, j) = TRC^{-1}(RGBa(i, j)) = 255\ (RGBa(i, j))^{1/2.2}$$

In the above formula, i is in a range of 1 through X, and j is in a range of 1 through Y.

In the step S190, the CPU 110 outputs the display outputting RGB value RGBout(i,j) from the output section 90 to the display 200.

Figure 4:
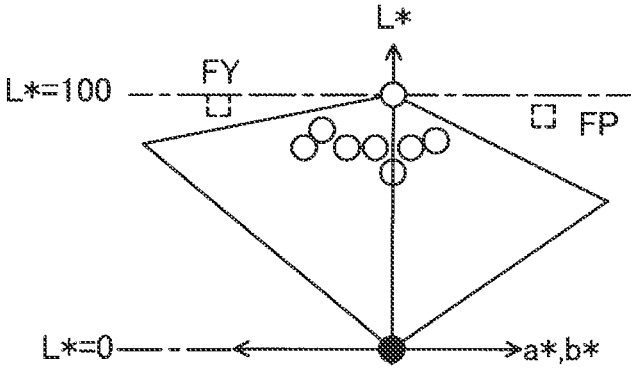
FIG. 4 is an explanatory diagram showing a distribution in an Lab space of colors included in an image IM.

FIG. 4 is an explanatory diagram showing a distribution in an Lab space of colors included in the image IM. Here, the quadrangle having a substantially rhombic shape represented by the solid line represents the gamut as a displayable limit of the display 200. The circles represent the colors which are included in the image IM, and are located inside the display gamut, and the diagram shows the fact that some colors FY, FP (fluorescent yellow, fluorescent pink) in the image IM represented by the quadrangles are located outside the gamut representing the displayable color of the display 200. In other words, it is understood that FY and FP fail to be located in an area where the display 200 can display the colors.

Figure 5:
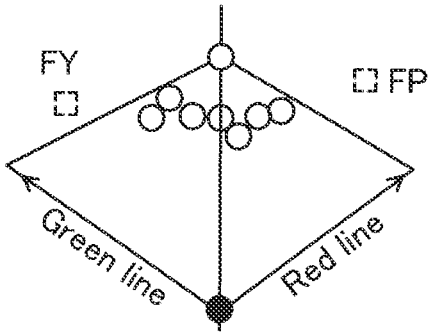
FIG. 5 is an explanatory diagram showing a color distribution in a linear RGB space after converting the colors included in the image IM into the linear RGB values of a display.

FIG. 5 is an explanatory diagram showing a color distribution in a linear RGB space after converting the colors included in the image IM into the linear RGB values of the display. In the linear RGB space, the gamut is formed based on a Red axis, a Green axis, and a Blue axis not shown. It is understood that also in the linear RGB space, some colors FY, FP of the image IM are located outside the gamut, and fail to be located in the area where the display 200 can display the colors.

Figure 6:
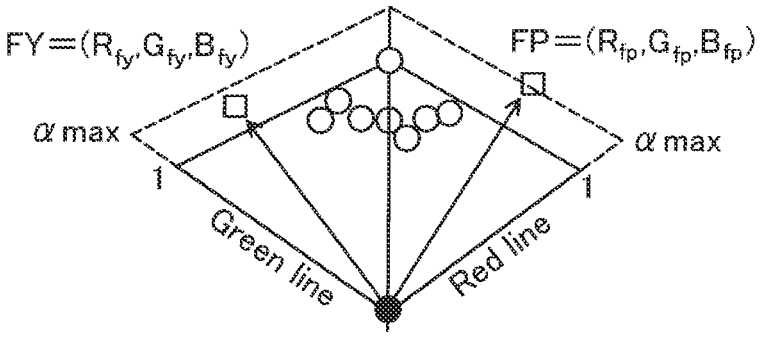
FIG. 6 is an explanatory diagram showing a gamut obtained by making a gamut in the linear RGB space $\alpha$max times as large as before.

FIG. 6 is an explanatory diagram showing the gamut obtained by multiplying the gamut in the linear RGB space by αmax. The value αmax can be obtained by the following formula as described above.

$$\alpha\max = \max(R(i, j), G(i, j), B(i, j))$$

In the above formula, i is in a range of 1 through X, and j is in a range of 1 through Y.

It is understood that some colors FY, FP of the image IM located outside the gamut in FIG. 5 are located inside the gamut represented by the dotted line obtained by making the gamut shown in FIG. 5 αmax times as large as before in FIG. 6.

Figure 7:
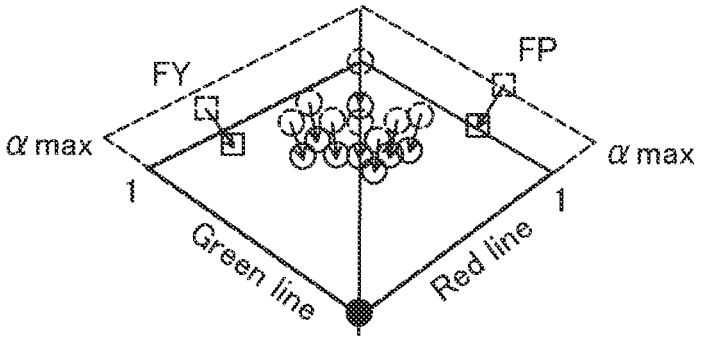
FIG. 7 is an explanatory diagram showing normalization of dividing the gamut by $\alpha$max.

FIG. 7 is an explanatory diagram showing the normalization of dividing the gamut shown in FIG. 6 by αmax. Due to this normalization, the linear RGB values RGBb(i,j) represented by the dotted lines are converted into the normalized linear RGB values RGBa(i,j) represented by the solid lines. Positions representing some colors FY, FP of the image IM located outside the gamut of RGB=(1,1,1) represented by the dotted quadrangles move inside the gamut (the solid line) of RGB=(1,1,1) or on the line of the gamut as represented by the solid quadrangles.

Figure 8:
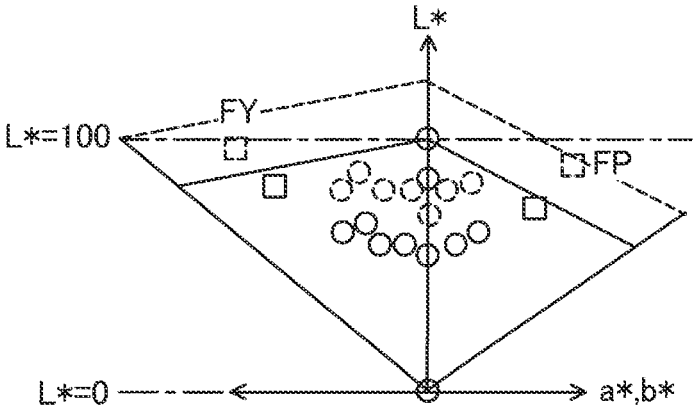
FIG. 8 is a diagram of converting the normalized linear RGB value into a chromatic value in the Lab space, and then comparing the result with a chromatic value in the Lab space of an original image IM.

FIG. 8 is a diagram of converting the normalized linear RGB value RGBa into the chromatic value in the Lab space, and then comparing the result with the chromatic value in the Lab space of the original image IM. In FIG. 8, the normalized chromatic values are represented by the solid lines, and the original chromatic values are represented by the dotted lines. The gamut represented by the dotted line shows a virtual gamut which can incorporate the chromatic values in the Lab space of the original image IM within the range thereof. It is understood that chromatic values in the Lab space of the original image IM are located outside the gamut represented by the solid line, but the chromatic values in the normalized Lab space are located inside the gamut represented by the solid line or on the line of the gamut.

As described hereinabove, according to the first embodiment, the CPU 110 obtains the tristimulus value XYZ(i,j) of the image IM using the chromatic value acquisition section 30. Then, the CPU 110 converts the tristimulus value XYZ (i,j) of the image IM into the unnormalized linear RGB value RGBb(i,j) using the RGB conversion section 40 and the XYZ-RGB conversion characteristic of the display 200. Further, the CPU 110 obtains the judgment value αmax for the unnormalized linear RGB value RGBb(i,j) using the maximum value acquisition section 50. The CPU 110 judges whether or not the judgment value αmax has exceeded 1 using the maximum value judgment section 60. When the judgment value αmax has exceeded 1, the CPU 110 divides the unnormalized linear RGB value RGBb(i,j) by the judgment value αmax to thereby calculate the normalized linear RGB value RGBa(i,j) using the normalization section 70. It should be noted that, when the judgment value αmax is no higher than 1, the CPU 110 makes the normalized linear RGB value RGBa(i,j) take the same value as the unnormalized linear RGB value RGBb(i,j) using the normalization section 70. Then, the CPU 110 converts the normalized linear RGB value RGBa(i,j) into the display outputting RGB value RGBout(i,j) using the outputting RGB conversion section 80 and the inverse characteristic of the TRC characteristic of the display 200. Lastly, the CPU 110 outputs the display outputting RGB value RGBout(i,j) to the display 200. As a result, even when the color such as a fluorescent color which is high in luminance and cannot be displayed by the display 200 is included in the image IM, it is possible for the image processing device 100 to convert all of the colors including the color high in luminance of the image IM into the displayable color of the display 200 to thereby display the image IM on the display 200. On this occasion, since the CPU 110 divides the linear RGB values of all of the pixels of the image IM by the judgment value αmax to thereby convert the linear RGB values uniformly toward the lower luminance, an uncomfortable feeling that the colors of the image displayed on the display 200 are altered is difficult to occur.

In the first embodiment, the CPU 110 divides the unnormalized linear RGB value RGBb(i,j) by the judgment value αmax to thereby generate the normalized linear RGB value RGBa(i,j) using the normalization section 70, but can divide the unnormalized linear RGB value RGBb(i,j) by the modulus k greater than 1. Here, providing the modulus k is a value no lower than the judgment value αmax, the normalized linear RGB value RGBa(i,j) obtained by dividing the unnormalized linear RGB value RGBb(i,j) by the modulus k becomes no higher than 1. As a result, it is possible to display the image IM on the display 200 without the uncomfortable feeling similarly to when dividing the unnormalized linear RGB value RGBb(i,j) by the judgment value αmax. When the modulus k is higher than 1 and lower than the judgment value αmax, regarding the colors having high luminance close to the judgment value αmax, the normalized linear RGB values RGBa(i,j) fail to become no higher than 1, but the conversion is performed uniformly toward the lower luminance, and therefore, the uncomfortable feeling that the colors of the image displayed on the display 200 are altered is difficult to occur.

In the first embodiment, since the CPU 110 converts the chromatic value Lab(i,j) in the Lab space into the tristimulus value XYZ(i,j) for each of the pixels of the image IM using the chromatic value acquisition section 30, it is possible to keep xy chromaticity. Further, it is possible to use the XYZ-RGB conversion characteristic provided from the manufacturer of the display 200.

Second Embodiment

Figure 9:
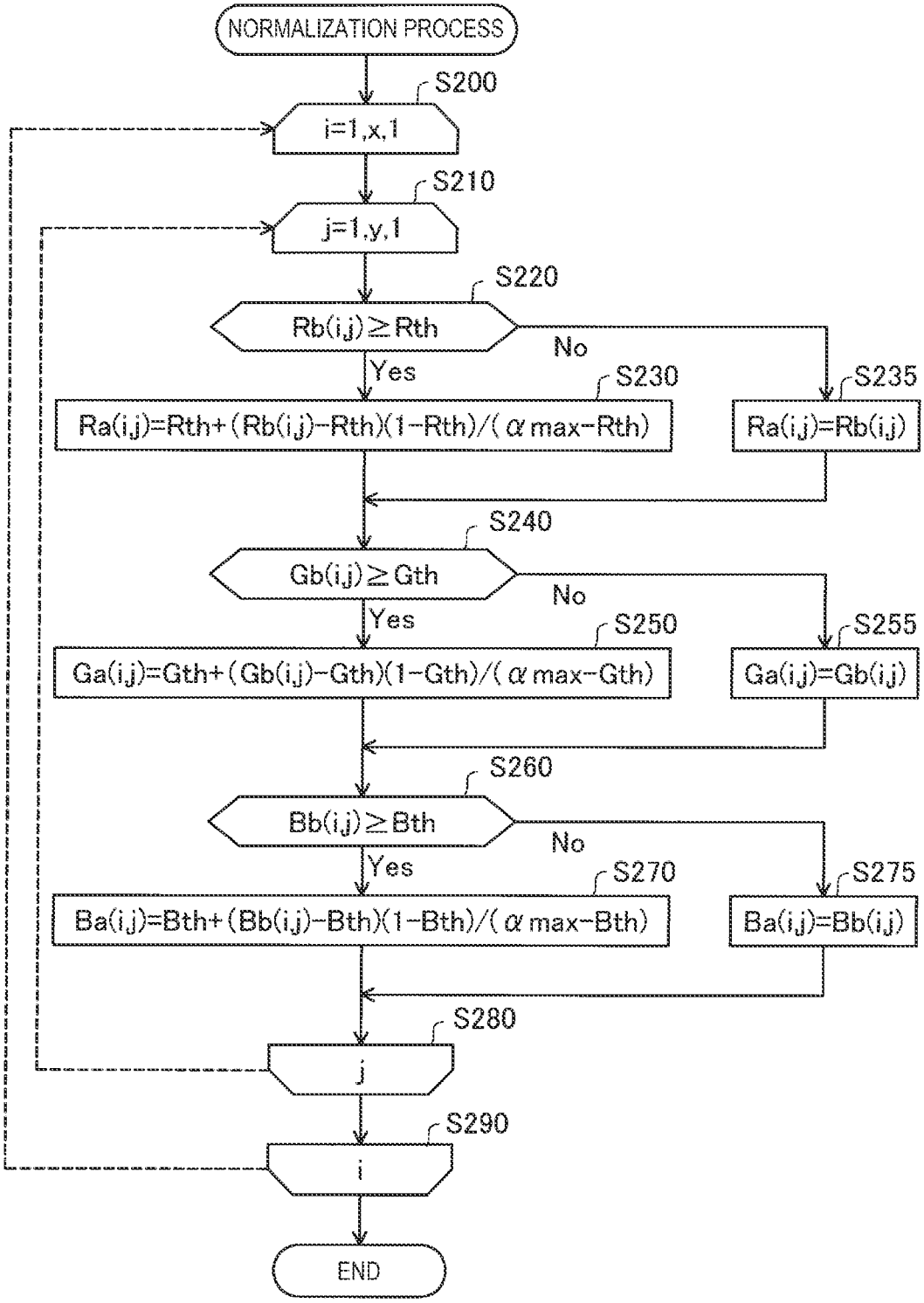
FIG. 9 is a processing flowchart of normalization executed by a CPU in a second embodiment.

FIG. 9 is a processing flowchart of the normalization executed by the CPU 110 in a second embodiment. In the first embodiment, the normalization is performed in the entire range of RGBb(i,j) without discriminating the colors from each other in the step S160 shown in FIG. 2, but in the second embodiment, the CPU 110 performs the normalization on the unnormalized linear RGB values RGBb(i,j) in a range in which Rb(i,j), Gb(i,j), and Bb(i,j) of the color are no lower than threshold values Rth, Gth, and Bth, respectively.

The steps S200 through S290 correspond to a dO loop using the x coordinate i of the image IM as a loop counter variable, and the steps S210 through S280 correspond to a dO loop using the y coordinate j of the image IM as a loop counter variable. Due to the double dO loop described above, all of the pixels of the image IM are selected in sequence in accordance with the coordinate(i,j) thereof.

In the step S220, the CPU 110 judges whether or not an unnormalized tonescale value Rb(i,j) of the red component of the pixel(i,j) of the image IM is no lower than the threshold value Rth using the normalization section 70, and when it is no lower than the threshold value, the transition of the processing to the step S230 is made, and when it is lower than the threshold value Rth, the transition of the processing to the step S235 is made.

In the step S230, the CPU 110 normalizes the unnormalized tonescale value Rb(i,j) of the red component into a normalized tonescale value Ra(i,j) with the following formula using the normalization section 70. Due to this normalization, the unnormalized tonescale value Rb(i,j) of the red component which is no lower than the threshold value Rth and no higher than the judgment value αmax is converted into the unnormalized tonescale value Rb(i,j) of the red component which is no lower than the threshold value Rth and no higher than 1.

$$Rb(i, j) = Rth + (Rb(i, j) - Rth)(1 - Rth)/(\alpha\max - Rth)$$

In this processing, the normalization section 70 sets the modulus to (αmax−Rth)/(1−Rth), divides the value obtained by subtracting the threshold value Rth from the unnormalized tonescale value Rb(i,j) by the modulus, and then adds the threshold value Rth with respect to the red component.

In the step S240, the CPU 110 makes the unnormalized tonescale value Rb(i,j) of the red component take the same value as the normalized tonescale value Ra(i,j) using the normalization section 70.

In the steps S240, S250, and S255, the CPU 110 converts an unnormalized tonescale value Gb(i,j) of the green component into a normalized tonescale value Ga(i,j) using the normalization section 70 similarly to the steps S220, S230, and S235. Further, in the steps S260, S270, and S275, the CPU 110 converts an unnormalized tonescale value Bb(i,j) of the blue component into a normalized tonescale value Ba(i,j) using the normalization section 70 similarly to the steps S220, S230, and S235.

Figure 10:
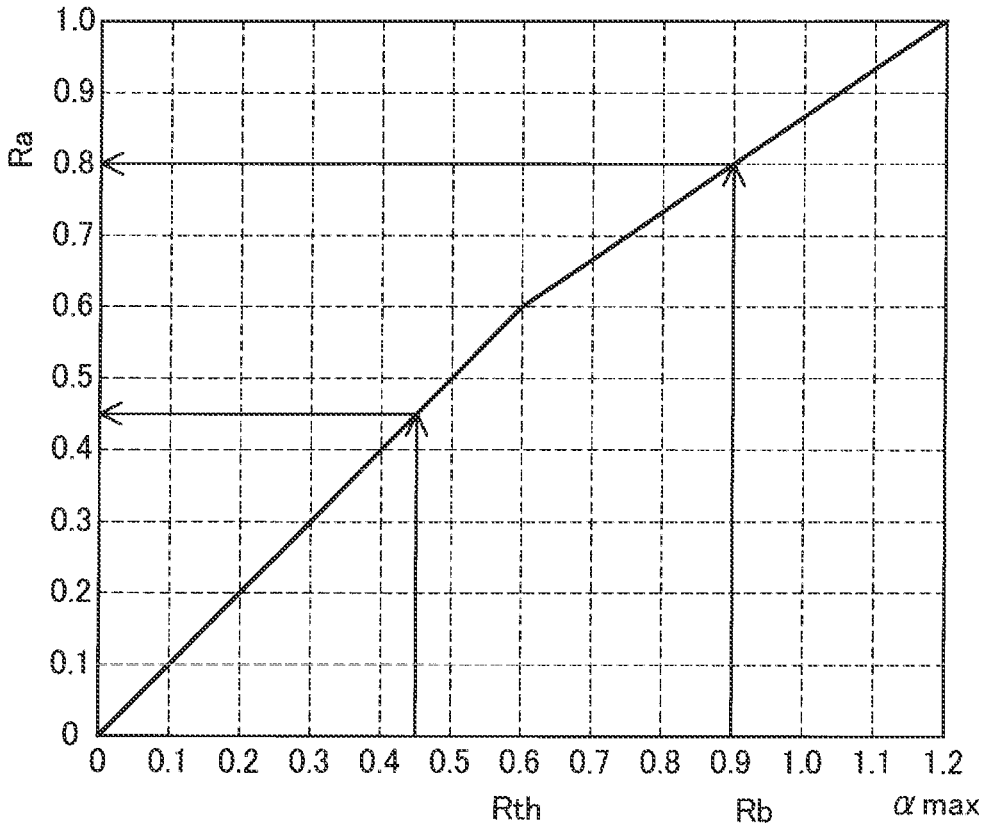
FIG. 10 is a graph showing a relationship between an unnormalized tonescale value of a red component and a normalized tonescale value.

FIG. 10 is a graph showing a relationship between the unnormalized tonescale value Rb of the red component and the normalized tonescale value Ra. In FIG. 10, the judgment value αmax=1.2, and the threshold value Rth of 0.6 are assumed. For example, in the pixel having the unnormalized tonescale value Rb of 0.9, the normalized tonescale value Ra of 0.8 is obtained by the conversion. Further, in the pixel having the unnormalized tonescale value Rb of 0.45 lower than the threshold value Rth, the normalized tonescale value Ra is kept at 0.45, and therefore, the unnormalized tonescale value Rb and the normalized tonescale value Ra take the same value. As is understood from FIG. 10, when the unnormalized tonescale value Rb is no lower than the threshold value Rth, the normalized tonescale value Ra is set to a value which is no lower than the threshold value Rth and no higher than the maximum value Dmax (=1) by the conversion, and when the unnormalized tonescale value Rb is lower than the threshold value Rth, the normalized tonescale value Ra is set to the same value as the unnormalized tonescale value Rb. The same applies to the green component and the blue component.

Figure 11:
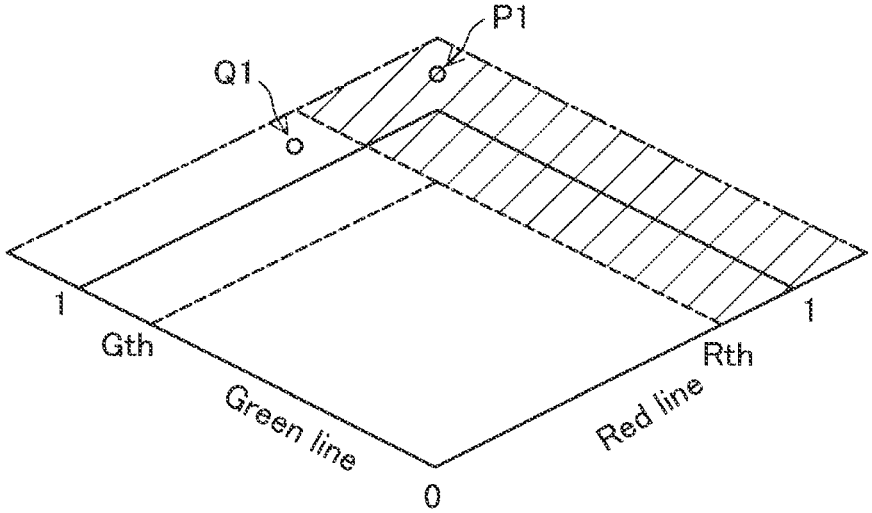
FIG. 11 is an explanatory diagram showing a range of an RGB value in which the unnormalized tonescale value of the red component is no lower than a threshold value.
Figure 12:
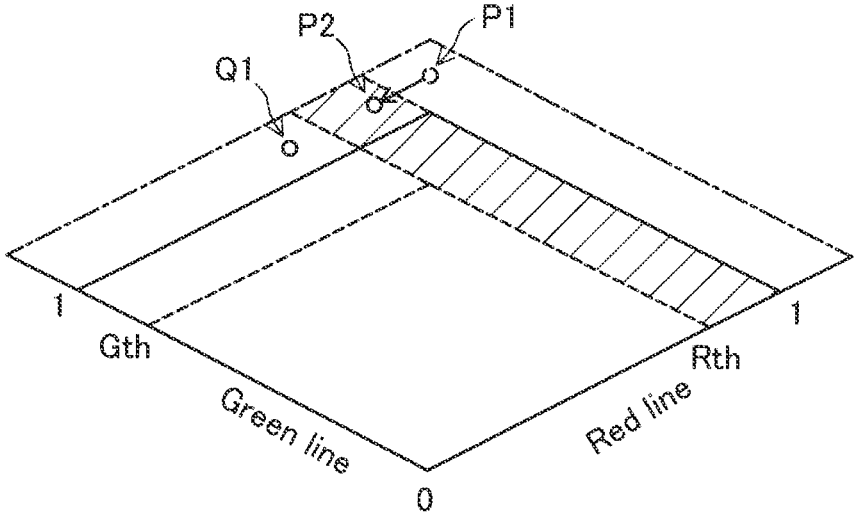
FIG. 12 is an explanatory diagram showing a range of a normalized RGB value after normalizing the RGB value in a range in which the unnormalized tonescale value of the red component is no lower than the threshold value.

FIG. 11 is an explanatory diagram showing a range of the RGB value RGBb in which the unnormalized tonescale value Rb of the red component is no lower than the threshold value Rth. The hatching area represents the range of the RGB value RGBb in which the tonescale value Rb of the red component is no lower than the threshold value Rth. FIG. 12 is an explanatory diagram showing a range of the normalized RGB value RGBa after normalizing the RGB value RGBb in the range in which the unnormalized tonescale value Rb of the red component is no lower than the threshold value Rth. The hatching area represents the range of the normalized RGB value RGBa. Due to the processing in the step S230 shown in FIG. 9, the tonescale value of the red component is normalized, and the hatching area shown in FIG. 11 is normalized into the hatching area shown in FIG. 12. A point P1 in FIG. 11 moves to a point P2 in FIG. 12 due to the normalization of the red component. Regarding a point Q1 in FIG. 11, since an unnormalized tonescale value Rb (Q1) of the red component is lower than the threshold value Rth, according to the processing in the step S235 shown in FIG. 9, a normalized tonescale value Ra (Q1) is located at the same position as the unnormalized tonescale value Rb (Q1) of the red component.

Figure 13:
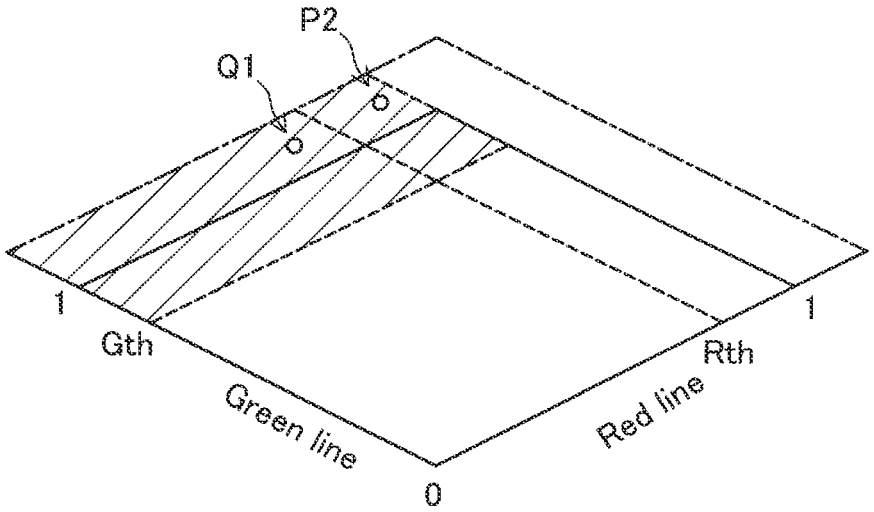
FIG. 13 is an explanatory diagram showing a range in which an unnormalized tonescale value of a green component is no lower than a threshold value after the normalization of the red component.
Figure 14:
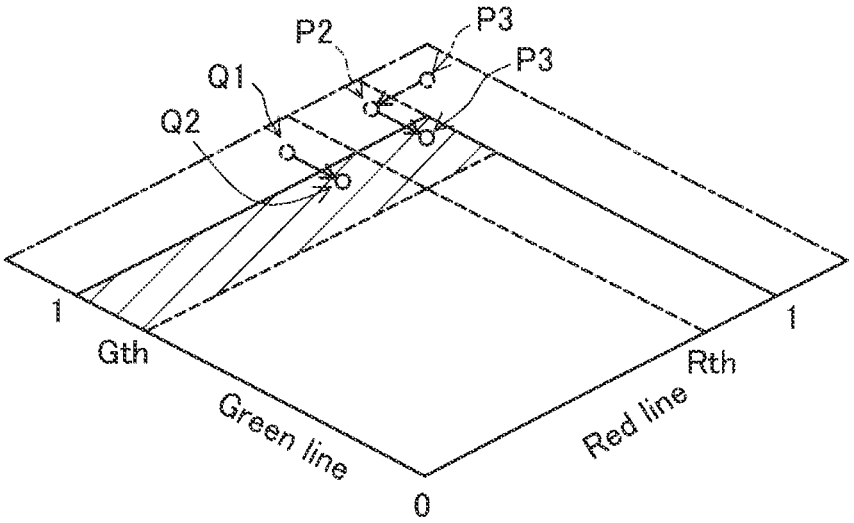
FIG. 14 is an explanatory diagram showing a range of the normalized RGB value after normalizing the range in which the unnormalized tonescale value of the green component is no lower than the threshold value.

FIG. 13 is an explanatory diagram showing a range in which the unnormalized tonescale value Gb of the green component is no lower than the threshold value Gth after the normalization of the red component. The hatching area represents the range in which the tonescale value Gb of the green component is no lower than the threshold value Gth. It should be noted that regarding the red component, due to the processing in the step S230 shown in FIG. 9, the tonescale value Rb is made no higher than 1. FIG. 14 is an explanatory diagram showing a range of the normalized RGB value RGBa after normalizing the RGB value RGBb in the range in which the unnormalized tonescale value Gb of the green component is no lower than the threshold value Gth. The hatching area represents the range of the normalized RGB value RGBa. Due to the processing in the step S250 shown in FIG. 9, the tonescale value of the green component is normalized, and the hatching area shown in FIG. 13 is normalized into the hatching area shown in FIG. 14. The point P2 in FIG. 13 moves to a point P3 in FIG. 14 due to the normalization of the green component. Similarly, the point Q1 in FIG. 13 moves to a point Q2 in FIG. 14 due to the normalization of the green component. It should be noted that the same applies to the blue component.

As described hereinabove, according to the second embodiment, the CPU 110 performs the normalization so that the normalized tonescale values Ra(i,j), Ga(i,j), and Ba(i,j) of the red component, the green component, and the blue component become no lower than the threshold values Rth, Gth, and Bth, and no higher than 1, respectively, when the unnormalized tonescale values Rb(i,j), Gb(i,j), and Bb(i,j) of the red component, the green component, and the blue component are in the ranges no lower than the predetermined threshold values Rth, Gth, and Bth, respectively, using the normalization section 70. As a result, even when the color such as a fluorescent color which is high in luminance and cannot be displayed by the display 200 is included in the image IM, it is possible for the image processing device 100 to convert all of the colors including the color high in luminance of the image IM into the displayable color of the display 200 to thereby display the image IM on the display 200. On this occasion, the conversion toward the lower luminance is performed on the colors having high luminance no lower than the threshold value out of the pixels of the image IM, but overtaking in luminance by the color having the luminance lower than the threshold value does not occur. As a result, the uncomfortable feeling that the colors of the image displayed on the display 200 are altered is difficult to occur.

In the second embodiment, assuming that the threshold values Rth, Gth, and Bth are all 0, the processing in the steps S220 through S275 becomes the same as the processing in the step S160 shown in FIG. 2.

In each of the embodiments described above, when the gamma correction has been performed on the signal value of each of the pixels of the image IM corresponding to the input device and to be received by the image input section 10, the chromatic value acquisition section 30 removes the gamma correction to receive the signal value as the chromatic value (Lab value), and further converts the signal value into the tristimulus value (XYZ value).

The processing sections and the method thereof described in the present disclosure can be realized by a dedicated computer which is provided by constituting a processor and a memory programmed so as to perform one or more functions embodied by a computer program. Alternatively, the processing sections and the method thereof described in the present disclosure can be realized by a dedicated computer provided by constituting a processor with one or more dedicated hardware logic circuits. Alternatively, the processing sections and the method thereof described in the present disclosure can be realized by one or more dedicated computers constituted by a combination of the processor and the memory programmed so as to perform one or more functions, and the processor constituted by one or more hardware logic circuits. Further, the computer program can be stored in a computer-readable non-transitory tangible recording medium in the form of instructions to be executed by a computer.

In each of the embodiments described above, when the chromatic value acquisition section 30 is capable of obtaining the linear RGB values of the image IM, the RGB conversion section 40 can be eliminated.

The present disclosure is not limited to the embodiments described above, but can be implemented in a variety of aspects within the scope or the spirit of the present disclosure. For example, the present disclosure can also be implemented in the following aspects. The technical features in the embodiments described above corresponding to the technical features in each of the aspects described below can arbitrarily be replaced or combined in order to solve some or all of the problems of the present disclosure, or to achieve some or all of the advantages of the present disclosure. Further, the technical feature can arbitrarily be eliminated unless described in the present specification as an essential element.

(1) According to an aspect of the present disclosure, there is provided an image processing device. The image processing device includes an image input section configured to receive input of an image, a chromatic value acquisition section configured to obtain a chromatic value with respect to each of pixels of the image, an RGB conversion section configured to convert the chromatic value of each of the pixels of the image into an unnormalized linear RGB value expressed by a linear RGB value based on a characteristic of a display which outputs the image, a normalization section configured to divide the unnormalized linear RGB value by a modulus higher than a maximum value of linear RGB values which express displayable colors of the display to thereby generate a normalized linear RGB value when the unnormalized linear RGB value of at least one of the pixels is higher than the maximum value, an outputting RGB conversion section configured to convert the normalized linear RGB value into a display outputting RGB value, and an output section configured to output the display outputting RGB value to the display. According to this aspect, it is possible to display the image after being normalized within the display band of the display without breaking the relative relationship with the other colors on the display even when the extra-color gamut color high in luminance represented by the fluorescent color outside the band of the display is included in the colors of the input image.

(2) In the image processing device according to the above aspect, the RGB conversion section may convert the chromatic value into the unnormalized linear RGB value using a chromatic value-RGB value conversion characteristic in the display, and the outputting RGB conversion section may convert the normalized linear RGB value into the display outputting RGB value using a reverse characteristic of a TRC characteristic. According to this aspect, it is possible to display the image after being normalized within the display band of the display taking the gamma characteristic of the display into consideration.

(3) In the image processing device according to the above aspect, there may further be included a maximum value acquisition section configured to obtain an unnormalized maximum value of the unnormalized linear RGB values, and a maximum value judgment section configured to judge whether or not a judgment value obtained by dividing the unnormalized maximum value by the maximum value is higher than 1, wherein when the judgment value is higher than 1, the normalization section may set the judgment value as the modulus. According to this aspect, it is possible to display the image after surely performing the normalization into the display band of the display.

(4) In the image processing device according to the above aspect, the normalization section may perform the normalization on the unnormalized linear RGB value within a range no lower than a predetermined threshold value so that the normalized linear RGB value becomes no lower than the threshold value and no higher than the maximum value for each of the colors of RGB. According to this aspect, it is possible to normalize only the unnormalized linear RGB values within the range no lower than the threshold value.

(5) In the image processing device according to the above aspect, the normalization section, in processing of pixels, may set the modulus as ((unnormalized maximum value of each color)−(the threshold value for each color))/((maximum value of each color)−(the threshold value for each color)), and may add the threshold value for each color to a value obtained by dividing ((unnormalized linear RGB value of each color)−(the threshold value for each color)) by the modulus to thereby calculate the normalized linear RGB value for each color. According to this aspect, it is possible to surely normalize the unnormalized linear RGB values within the range no lower than the threshold value.

(6) In the image processing device according to the above aspect, the chromatic value acquisition section may obtain a tristimulus value (XYZ value), and the RGB conversion section may convert the tristimulus value (XYZ value) into the unnormalized linear RGB value. According to this aspect, the xy chromaticity can be kept.

(7) According to an aspect of the present disclosure, there is provided an image processing method. The image processing method includes the steps of receiving input of an image, obtaining a chromatic value with respect to each of pixels of the image, converting the chromatic value of each of the pixels of the image into an unnormalized linear RGB value expressed by a linear RGB value based on a characteristic of a display which outputs the image, dividing the unnormalized linear RGB value by a modulus higher than a maximum value of linear RGB values which express displayable colors of the display to thereby generate a normalized linear RGB value when the unnormalized linear RGB value of at least one of the pixels is higher than the maximum value, converting the normalized linear RGB value into a display outputting RGB value, and outputting the display outputting RGB value to the display. According to this aspect, it is possible to display the image after being normalized within the display band of the display without breaking the relative relationship with the other colors on the display even when the extra-color gamut color high in luminance represented by the fluorescent color outside the band of the display is included in the colors of the input image.

(8) In the image processing method according to the above aspect, there may further be included the steps of converting the chromatic value into the unnormalized linear RGB value using a chromatic value-RGB value conversion characteristic in the display, and converting the normalized linear RGB value into the display outputting RGB value using a reverse characteristic of a TRC characteristic. According to this aspect, it is possible to display the image after being normalized within the display band of the display taking the gamma characteristic of the display into consideration.

(9) In the image processing method according to the above aspect, there may further be included the steps of obtaining an unnormalized maximum value of the unnormalized linear RGB values, and judging whether or not a judgment value obtained by dividing the unnormalized maximum value by the maximum value is higher than 1, wherein when the judgment value is higher than 1, the judgment value may be set as the modulus. According to this aspect, it is possible to display the image after surely performing the normalization into the display band of the display.

(10) In the image processing method according to the above aspect, the normalization on the unnormalized linear RGB value within a range no lower than a predetermined threshold value may be performed so that the normalized linear RGB value becomes no lower than the threshold value and no higher than the maximum value for each of the colors of RGB. According to this aspect, it is possible to normalize only the unnormalized linear RGB values within the range no lower than the threshold value.

(11) In the image processing method according to the above aspect, in processing of pixels, the modulus may be set as ((unnormalized maximum value of each color)−(the threshold value for each color))/((maximum value of each color)−(the threshold value for each color)), and the threshold value for each color may be added to a value obtained by dividing ((unnormalized linear RGB value of each color)−(the threshold value for each color)) by the modulus to thereby calculate the normalized linear RGB value for each color. According to this aspect, it is possible to surely normalize the unnormalized linear RGB values within the range no lower than the threshold value.

(12) In the image processing method according to the above aspect, there may further be included the steps of obtaining a tristimulus value (XYZ value), and converting the tristimulus value (XYZ value) into the unnormalized linear RGB value. According to this aspect, the xy chromaticity can be kept.

The present disclosure can be implemented in a variety of aspects other than the image processing device and the image processing method. The present disclosure can be implemented in the aspects such as an image display device, an image display method, an image processing program, and a recording medium storing the image processing program.

What is claimed is:

1. An image processing device comprising:

an image input section configured to receive input of an image;

a chromatic value acquisition section configured to obtain a chromatic value with respect to each of pixels of the image;

an RGB conversion section configured to convert the chromatic value of each of the pixels of the image into an unnormalized linear RGB value expressed by a linear RGB value based on a characteristic of a display which outputs the image;

a normalization section configured to divide the unnormalized linear RGB value by a modulus higher than a maximum value of linear RGB values which express displayable colors of the display to thereby generate a normalized linear RGB value when the unnormalized linear RGB value of at least one of the pixels is higher than the maximum value;

an outputting RGB conversion section configured to convert the normalized linear RGB value into a display outputting RGB value; and an output section configured to output the display outputting RGB value to the display.

2. The image processing device according to claim 1, wherein the RGB conversion section converts the chromatic value into the unnormalized linear RGB value using a chromatic value-RGB value conversion characteristic in the display, and the outputting RGB conversion section converts the normalized linear RGB value into the display outputting RGB value using a reverse characteristic of a TRC characteristic.

3. The image processing device according to claim 1, further comprising:

a maximum value acquisition section configured to obtain an unnormalized maximum value of the unnormalized linear RGB values; and a maximum value judgment section configured to judge whether or not a judgment value obtained by dividing the unnormalized maximum value by the maximum value is higher than 1, wherein when the judgment value is higher than 1, the normalization section sets the judgment value as the modulus.

4. The image processing device according to claim 1, wherein the normalization section performs the normalization on the unnormalized linear RGB value within a range no lower than a predetermined threshold value so that the normalized linear RGB value becomes no lower than the threshold value and no higher than the maximum value for each of the colors of RGB.

5. The image processing device according to claim 4, wherein the normalization section, in processing of pixels, sets the modulus as ((unnormalized maximum value of each color)−(the threshold value for each color))/((maximum value of each color)−(the threshold value for each color)), and adds the threshold value for each color to a value obtained by dividing ((unnormalized linear RGB value of each color)−(the threshold value for each color)) by the modulus to thereby calculate the normalized linear RGB value for each color.

6. The image processing device according to claim 1, wherein the chromatic value acquisition section obtains a tristimulus value (XYZ value), and the RGB conversion section converts the tristimulus value (XYZ value) into the unnormalized linear RGB value.

7. An image processing method comprising:

receiving input of an image;

obtaining a chromatic value with respect to each of pixels of the image;

converting the chromatic value of each of the pixels of the image into an unnormalized linear RGB value expressed by a linear RGB value based on a characteristic of a display which outputs the image;

dividing the unnormalized linear RGB value by a modulus higher than a maximum value of linear RGB values which express displayable colors of the display to thereby generate a normalized linear RGB value when the unnormalized linear RGB value of at least one of the pixels is higher than the maximum value;

converting the normalized linear RGB value into a display outputting RGB value; and outputting the display outputting RGB value to the display.

8. The image processing method according to claim 7, further comprising:

converting the chromatic value into the unnormalized linear RGB value using a chromatic value-RGB value conversion characteristic in the display; and converting the normalized linear RGB value into the display outputting RGB value using a reverse characteristic of a TRC characteristic.

9. The image processing method according to claim 7, further comprising:

obtaining an unnormalized maximum value of the unnormalized linear RGB values; and judging whether or not a judgment value obtained by dividing the unnormalized maximum value by the maximum value is higher than 1, wherein when the judgment value is higher than 1, the judgment value is set as the modulus.

10. The image processing method according to claim 7, wherein the normalization on the unnormalized linear RGB value within a range no lower than a predetermined threshold value is performed so that the normalized linear RGB value becomes no lower than the threshold value and no higher than the maximum value for each of the colors of RGB.

11. The image processing method according to claim 10, wherein in processing of pixels, the modulus is set as ((unnormalized maximum value of each color)−(the threshold value for each color))/((maximum value of each color)−(the threshold value for each color)), and the threshold value for each color is added to a value obtained by dividing ((unnormalized linear RGB value of each color)−(the threshold value for each color)) by the modulus to thereby calculate the normalized linear RGB value for each color.

12. The image processing method according to claim 7, further comprising:

obtaining a tristimulus value (XYZ value); and converting the tristimulus value (XYZ value) into the unnormalized linear RGB value.

* * * * *